US006749265B1

(12) United States Patent
Wang

(10) Patent No.: US 6,749,265 B1
(45) Date of Patent: Jun. 15, 2004

(54) SEAT OF A METALLIC CHAIR

(75) Inventor: Tin-Chou Wang, Tainan Hsien (TW)

(73) Assignee: Ideal Concepts Inc., Taipei (TW)

( * ) Notice: Subject to any disclaimer, the term of this patent is extended or adjusted under 35 U.S.C. 154(b) by 0 days.

(21) Appl. No.: 10/425,655

(22) Filed: Apr. 30, 2003

(51) Int. Cl.[7] ..... A47C 7/00; F18M 11/20

(52) U.S. Cl. ..... 297/440.1; 297/440.14; 297/440.22; 297/440.23; 297/440.24; 248/188.1

(58) Field of Search ..... 297/440.1, 440.14, 297/440.22, 440.23, 440.24; 108/157.16, 157.1; 248/188.1, 188, 188.8, 165

(56) References Cited

U.S. PATENT DOCUMENTS 692,506 A * 2/1902 Ecker ..... 297/461
2,010,306 A * 8/1935 Leech ..... 248/412
2,265,841 A * 12/1941 Jankowski ..... 297/440.22
3,032,375 A * 5/1962 Lalandre ..... 297/440.24
3,865,050 A * 2/1975 Cecchetti ..... 108/19
4,848,245 A * 7/1989 Piretti ..... 108/156
5,131,718 A * 7/1992 Cooper ..... 297/452.1
5,377,601 A * 1/1995 Cashen ..... 108/158
5,688,287 A * 11/1997 Cline ..... 5/310
5,887,948 A * 3/1999 Hannes ..... 297/411.35
6,467,843 B1 * 10/2002 Rossborough ..... 297/344.18
6,484,649 B1 * 11/2002 Wang ..... 108/158

* cited by examiner

*Primary Examiner*—Peter M. Cuomo
*Assistant Examiner*—Sarah C. Burnham
(74) *Attorney, Agent, or Firm*—Rosenberg, Klein & Lee

(57) ABSTRACT

A seat of a chair is provided with a plastic main body, a metallic upper cover joined to upper and annular sides of the main body, and a metallic lower cover securely disposed over the bottom of the main body. The metallic covers increase the strength of the seat. The bottom of the plastic main body is formed with vertical connecting tubes, which are tightly fitted around corresponding sleeves secured to upper ends of metallic legs of the chair. The tubes have inner annular protrusions, which are engaged with annular grooves formed on outer sides of the sleeves; and, the seat matches the metallic legs to a greater degree because the outer side of the seat is made of metal.

4 Claims, 5 Drawing Sheets

SEAT OF A METALLIC CHAIR

BACKGROUND OF THE INVENTION

1. Field of the Invention

The present invention relates to an improvement on a seat of a metallic chair, more particularly one, which is formed with a structure different from seats of those chairs that have similar usages so as to emit feeling of quality.

2. Brief Description of the Prior Art

Research and design have been made to provide improvements on various existent tools and house furniture to better quality of life for people. In other words, tools, house furniture etc. have to be made with pleasant appearance and feeling of quality besides the practical aspects. Common conventional stools consist of a metallic support, and a plastic seat. Because the seat is made of plastics, different from the metallic material of the support, it doesn't match the support well. Consequently, appearance of the chair isn't attractive, and is lack of feeling of quality.

SUMMARY OF THE INVENTION

It is a main object of the present invention to provide a metallic shell to a seat for making the seat match metallic legs of chairs.

A metallic upper cover is joined to upper and annular sides of a plastic main body of the seat, and a metallic lower cover is securely disposed over the bottom of the main body; the bottom of the plastic main body is formed with vertical connecting tubes, which are passed through corresponding ones of holes of the lower cover, and tightly fitted around corresponding ones of sleeves secured to upper ends of metallic legs of the chair.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
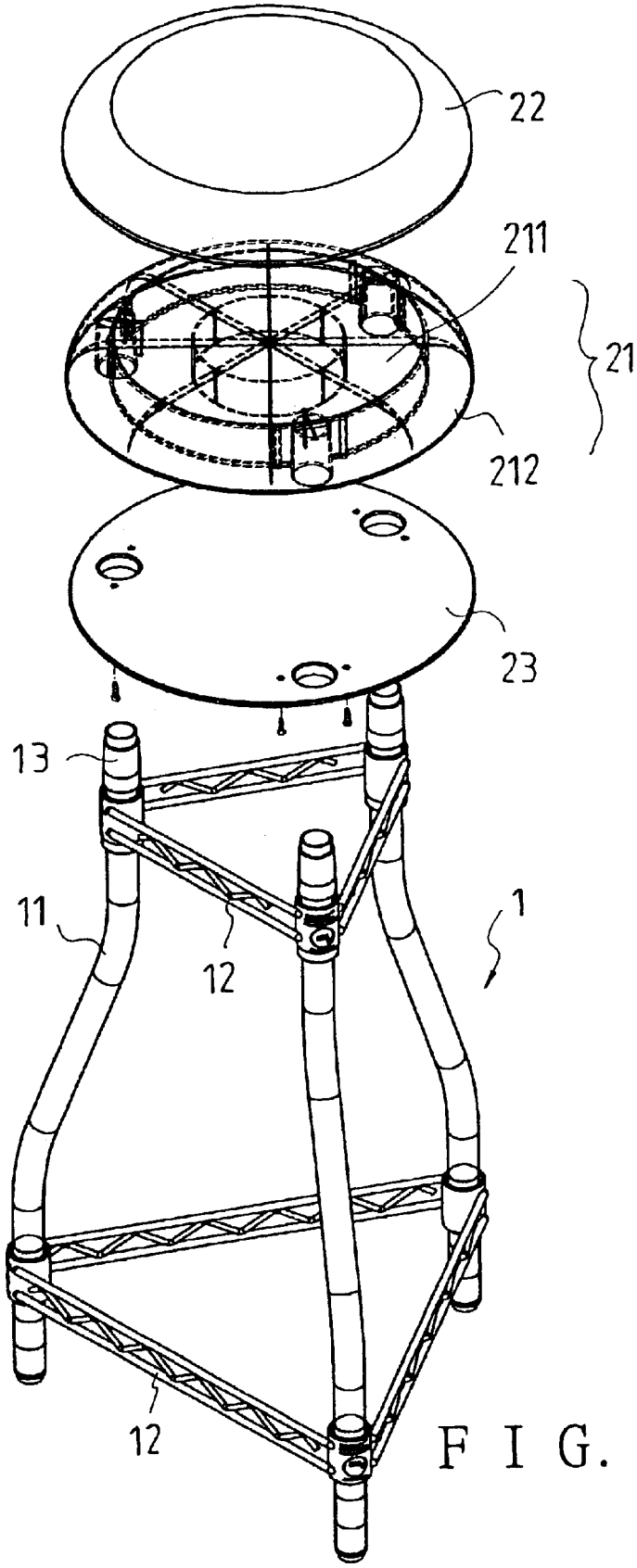
FIG. 1 is an exploded perspective view of a chair with the seat according to the present invention.

Referring to FIG. 1, a preferred embodiment of a chair in the present invention includes a metallic support 1, and a seat 2; the support 1 consists of at least three legs, and connecting elements 12 joining the legs together; plastic fastening sleeves 13, which are formed with annular grooves 131 on outer sides, are passed around upper ends of the legs; the seat 2 is comprised of a main body 21, a metallic upper cover 22, and a metallic lower cover 23.

Figure 2:
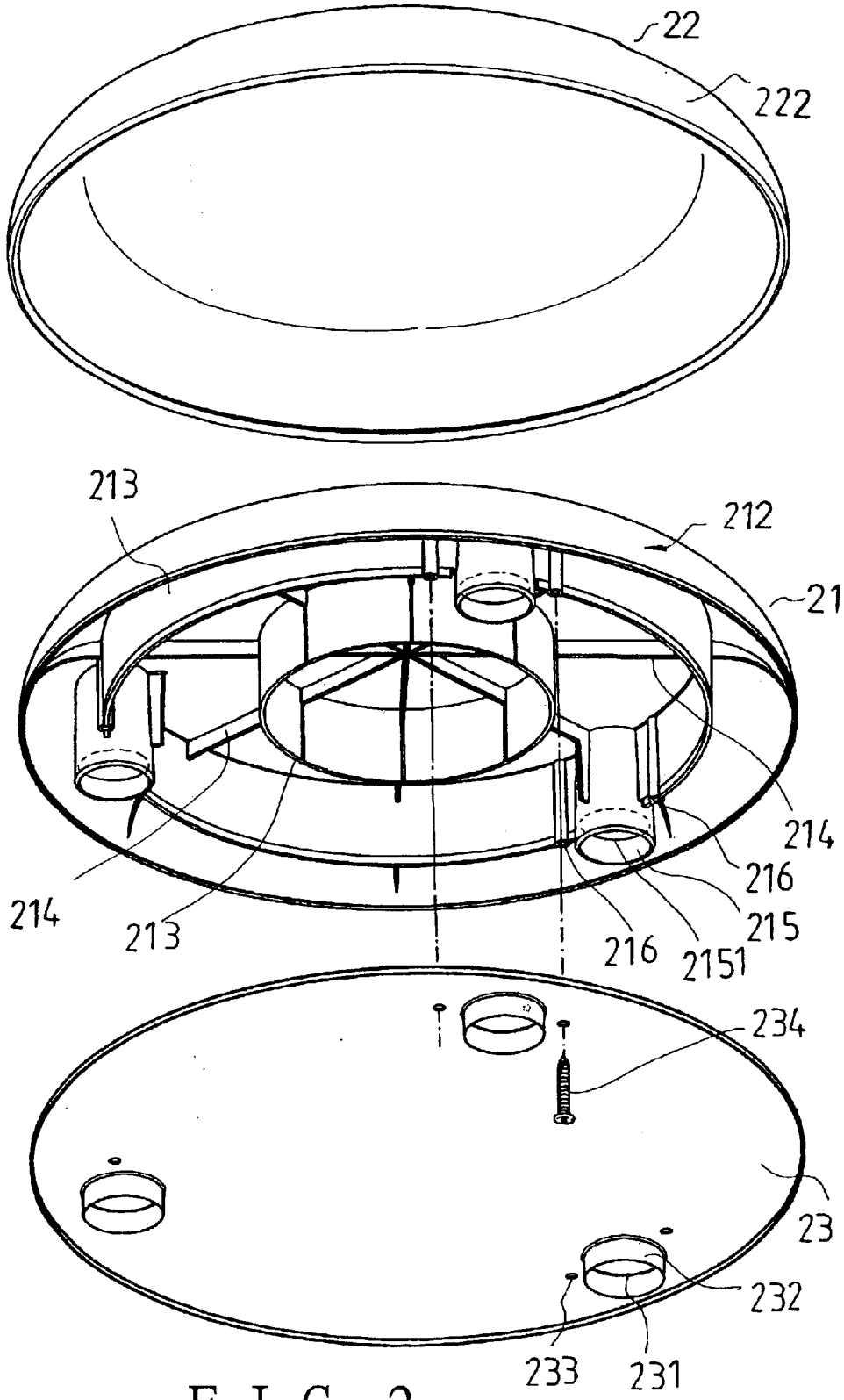
FIG. 2 is an exploded perspective view of the seat according to the present invention.

Referring to FIG. 2, the main body 21 of the seat 2 has a middle portion 211, and an annular portion 212 projecting downwards from the edge of the middle portion 211; the annular portion 212 is preferably shaped such that a vertical cross-sectional view thereof is convexly curved on the outward side. The main body 21 has several strengthening portions 213, which project down from the bottom of the middle portion 211, and which forms several circles. The main body 21 has strengthening ribs 214, which project down from the bottom of the middle portion 211, and which forms a radial pattern. The main body 21 has connecting tubes 215, which project down from the bottom of the middle portion 211, and which are formed at locations corresponding to the upper ends of the legs. In addition, each connecting tube 215 has an annular protrusion 2151 on an inner side. The main body 21 further has connecting posts 216 near to the connecting tubes 215 on the bottom thereof; each post 216 has a longitudinal screw hole; the connecting tubes 215, and the posts 216 are preferably joined to the strengthening portions 213 to be steadier.

The upper cover 22 of the seat 2 is shaped so as to be capable of fitting over the upper side of the main body 21, and has an annular portion 222, which extends beyond lower end of the annular portion 212 of the main body 21 when the cover 22 is joined to the main body 21.

The lower cover 23 is generally flat; the edge of the lower cover 23 is shaped so as to be over the bottom of the main body 21 when the cover 23 and the main body 21 are joined together. The lower cover 23 has connecting holes 231, and through holes 233 formed at locations corresponding to the connecting tubes 215, and the connecting posts 216 respectively. Annular projections 232 are formed around the connecting holes 231 on the bottom of the lower cover 23.

Figure 3:
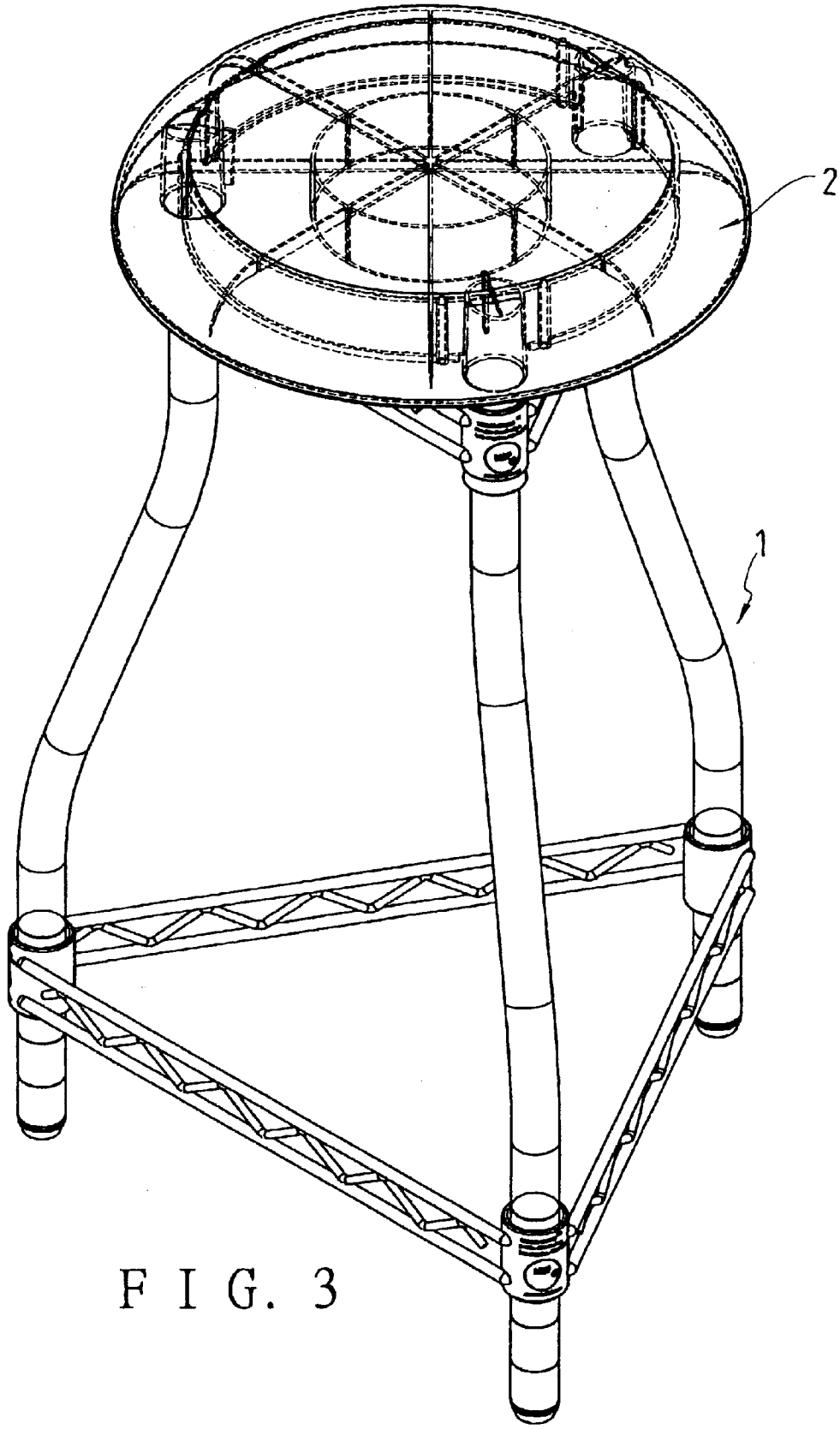
FIG. 3 is a perspective view of the chair with the seat according to the present invention.
Figure 4:
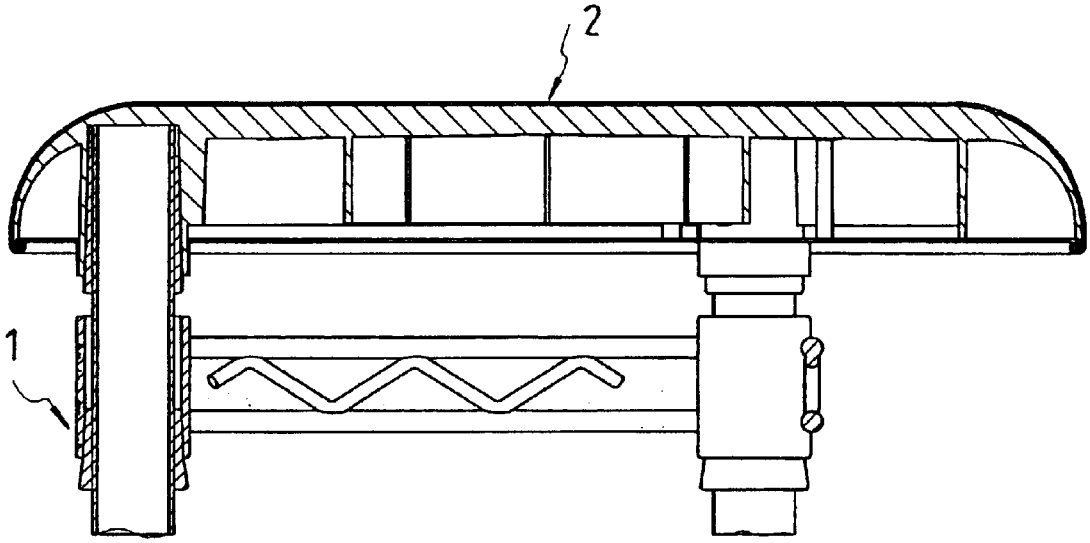
FIG. 4 is a partial cross-sectional view of the chair with the seat according to the present invention.
Figure 5:
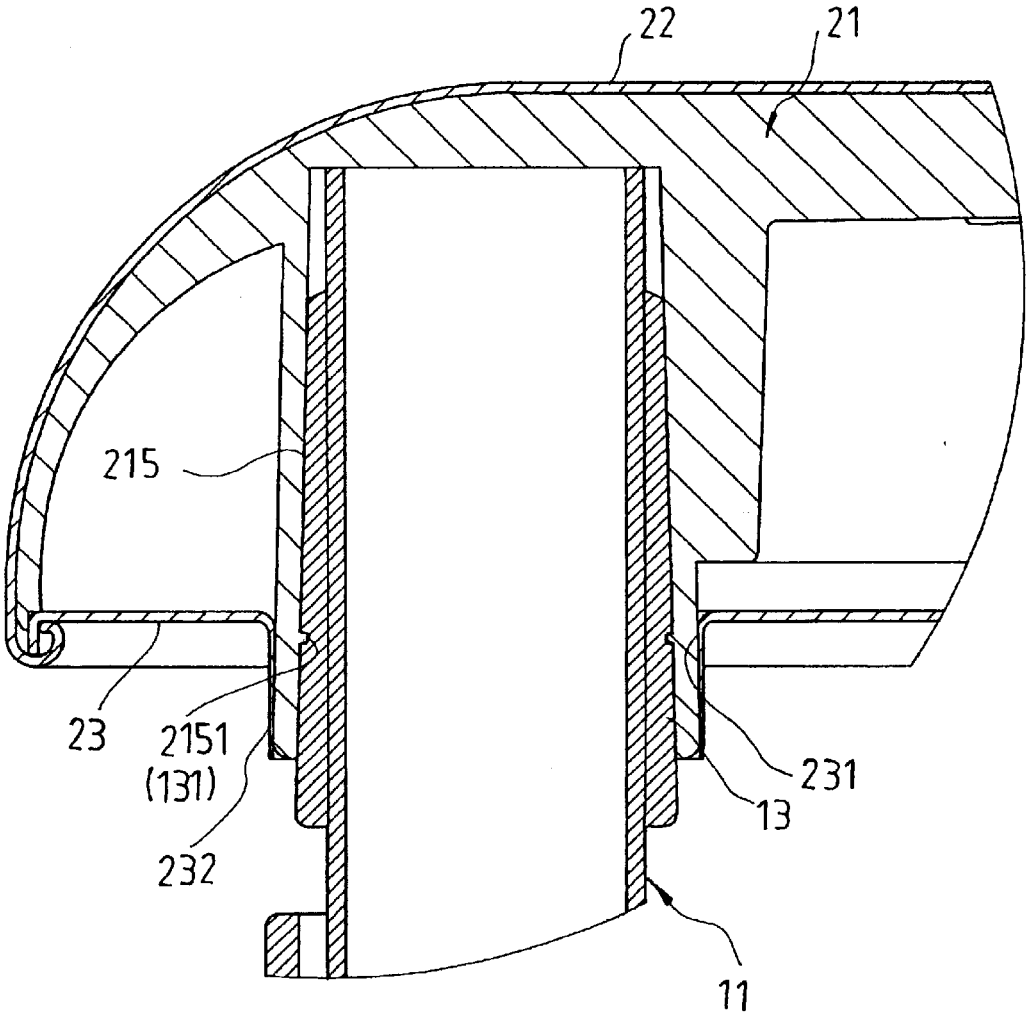
FIG. 5 is a partial and enlarged cross-sectional view of the chair with the seat according to the present invention.

In combination, referring to FIGS. 3, and 4, the upper and the lower covers 22, 23 are respectively fitted over the upper, and the lower sides of the main body 21, and the connecting tubes 215 are closely passed through corresponding connecting holes 231 of the lower cover 23. Then, screws 234 are passed through the through holes 233, and screwed into the screw holes of the connecting posts 216 so that the lower cover 23 is securely joined to the main body 21. And, the annular portion 222 of the upper cover 22 is folded to contact and engage the edge of the bottom of the lower cover 23 at those portions that project beyond the lower end of the annular portion 212 of the main body 21; thus, the upper cover 22 is securely joined to the main body 21. The seat 2 is securely joined to the support 1 with the connecting tubes 215 being closely passed around corresponding fastening sleeves 13 at the upper ends of the legs, and with the inner annular protrusions 2151 of the tubes 215 being engaged with the outer annular grooves 13 of the sleeves 12.

From the above description, it can be easily understood that the seat of a chair in the present invention has advantages as followings:

1. The seat has the metallic upper and lower covers 22, 23 forming the outer side thereof it can match the metallic support 1 to make the chair have more pleasant appearance.
2. The annular projections 232 of the lower cover 23 are mounted around the connecting tubes 215 of the main body 21 therefore strength of the tubes 215 increases, and in turns, the tubes 215 can't break even if relatively heavy load is on the chair.
3. The seat can be easily fitted to the appropriate location of the legs of the support 1, and is very steady with the inner annular protrusions 2151 of the tubes 215 being engaged with the outer annular grooves 13 of the sleeves 12.

What is claimed is:

1. A seat of a metallic chair, comprising:

a main body having a plurality of connecting tubes projecting downwards from a bottom thereof; each connecting tube having an annular protrusion formed on an inner side;

a metallic upper cover joined to the main body; the upper cover being shaped to extend over and substantially envelop upper and annular sides of the main body; and, a metallic lower cover disposed to extend across the bottom of the main body, the main body being thereby sandwiched between the metallic upper and lower covers; the lower cover having connecting holes formed at locations corresponding to the connecting tubes of the main body; annular projections being formed around the connecting holes on a bottom of the lower cover; the lower cover being joined to the main body with the annular projections being closely fitted around corresponding ones of the connecting tubes;

the connecting tubes being closely fitted around corresponding ones of sleeves secured to upper ends of legs of a chair with the annular protrusions being engaged with annular grooves formed on outer sides of the sleeves.

2. The seat of a metallic chair as claimed in claim 1, wherein the main body is formed with strengthening portions and strengthening ribs on the bottom thereof.

3. The seat of a metallic chair as claimed in claim 1, wherein the upper cover is folded to contact and engage an edge of a bottom of the lower cover at those portions thereof that project downwards beyond a lower edge of the main body.

4. The seat of a metallic chair as claimed in claim 1, wherein the main body has a plurality of connecting posts, each of which has a longitudinal screw hole, near to the connecting tubes thereof, and the lower cover has connecting holes formed at locations corresponding to the connecting posts; screws being passed through a through holes and screwed into the connecting posts to secure the lower cover to the main body.

* * * * *